United States Patent [19]

Bober et al.

[11] Patent Number: 4,708,469

[45] Date of Patent: Nov. 24, 1987

[54] INTERACTIVE SYSTEM FOR SIGNATURE PRODUCTION

[75] Inventors: Henry T. Bober, Fairport; Michael S. Doery, Rochester, both of N.Y.

[73] Assignee: Xerox Corporation, Stamford, Conn.

[21] Appl. No.: 897,570

[22] Filed: Aug. 18, 1986

[51] Int. Cl.[4] ..... G03G 15/00

[52] U.S. Cl. ..... 355/77; 355/14 R; 355/14 CU; 355/3 R; 355/25; 355/23; 355/24; 271/3.1

[58] Field of Search ..... 355/14 R, 3 R, 14 SH, 355/3 SH, 14 CU, 77, 24, 25, 26, 23; 271/3, 3.1; 364/900

[56] References Cited

U.S. PATENT DOCUMENTS

| | | | |
|---|---|---|---|
| 4,062,061 | 12/1977 | Batchelor et al. | 364/900 |
| 4,188,881 | 2/1980 | Bruning | 101/141 |
| 4,218,130 | 8/1980 | Satomi et al. | 355/14 R |
| 4,315,687 | 2/1982 | Breuers et al. | 355/75 |
| 4,334,765 | 6/1982 | Clark | 355/14 |
| 4,511,241 | 4/1985 | Tsudaka et al. | 355/14 CU |
| 4,561,772 | 12/1985 | Smith | 355/14 CU X |
| 4,614,421 | 9/1986 | Nishiyama | 355/14 CU |

*Primary Examiner*—A. C. Prescott

*Attorney, Agent, or Firm*—Ronald F. Chapuran

[57] ABSTRACT

The invention is a simple method for quickly defining page numbers for signature production, calculating a check value based on the total of page numbers, and displaying document identities and orientations on the platen for each signature to form a booklet. In particular, the operator enters the number of pages to appear in the booklet, the control calculates the number of pages in the finished book, the total number of signatures and a check value. The pagination of signatures is displayed for ease of operator orientation.

7 Claims, 7 Drawing Figures

INTERACTIVE SYSTEM FOR SIGNATURE PRODUCTION

BACKGROUND OF THE INVENTION

This invention relates to electrophotographic apparatus and, more particularly, it relates to the ordering of signatures in the formation of booklets from individual documents.

As is well known, a signature is a sheet containing a multiple of numbered pages which when folded and nested one inside of the other becomes one unit of a pamphlet or book. Given a series of original documents which are to read in order from page 1 through page 8, for example, it is logical to form a booklet which maintains the identical order. If the booklet is formed from sheets of paper (called signatures) carrying four images of the original documents in original sequence, the booklet made up of the folded sheets will contain images of the original which are not in sequential order. Thus, the correct placement of images on each signature is essential to providing a booklet in logical sequence in the finished product.

In general, the systematic ordering of document is well known in the prior art. For example, U.S. Pat. No. 4,218,130 shows a method for the production of a bundle of duplicate copies of pages of the same order and arrangement as a book original regardless of whether the book original is bound on the left side or on the right side or whether the first and last page is to be copied have even or odd numbers. U.S. Pat. No. 4,315,687 discloses a positioning surface having at least two distinct areas upon each which an original can be laid for copying and each area is bordered by a lateral arrest so plural originals laid in the areas and against the arrest will be fed together to exact positions on the exposure plate for copying on one sheet of receiving material in one copying run of the apparatus. U.S. Pat. No. 4,188,881 discloses that a certain page order sequence of originals can be devised to simplify the collating of sheets and for simplifying the cutting into two stacks of standard size sheets a stack of printed sheets.

One of the most difficult challenges, however, constraining on line introduction of signature production and finishing is the page ordering of the input documents. U.S. Pat. No. 4,334,765 discloses the preparation of booklets by permitting simplified operator manipulations of a copier which forms adjacent images from sequential original sheets. An automatic document feed presents successive original documents from the input stack to the reproduction position, the original documents are initially fed to the copier in a first sequence but are not all imaged. The originals are then stacked and are again presented to the reproduction position, some of the previous unimaged originals forming images on different portions of the same copy sheets. It is also known as described in the operator's instruction for the Xerox 7000 machine signature maker to use a calibrated table and to follow the step by step instructions for the placement of originals on a platen. There is also disclosed in the Xerox 1090 machine operator manual a step-by-step procedure to place documents on the platen with reference to a numbering table. A difficulty with the prior art systems is that they are often relatively complex and not easily adapted to the casual operator. It would be desirable therefore to provide a new and improved page ordering technique for input documents in the production of signatures to form booklets. It is another object of the present invention to provide a simple method combined with interactive graphics to prompt and guide the operator in proper page ordering of input documents for signature production.

Further advantages of the present invention will become apparent as the following description proceeds, and the features characterizing the invention will be pointed out with particularity in the claims annexed to and forming a part of this specification.

SUMMARY OF THE INVENTION

Briefly, the present invention is a simple method for quickly defining page numbers for each signature, calculating a check value based on the total of page numbers in each signature, and displaying document identities and orientations on the platen for each signature. In particular, the operator enters the number of pages to appear in the book, the machine micro processor calculates the number of pages in the finished book, the total number of signatures and a check value. The pagination of signatures is displayed, illustrating for the operator the signature orientation.

BRIEF DESCRIPTION OF THE DRAWINGS

For a better understanding of the present invention, reference numerals have been applied to like parts wherein:

Referring to FIG. 1, there is shown a typical reproduction machine 10 and a controller including a central processor unit (CPU) module 12, input/output (I/O) module 14 and CPU interface module 16 that can incorporate the present invention. Address, data and control buses 18, 20 and 22 couple CPU module 12 and I/O module 14.

Figure 1:
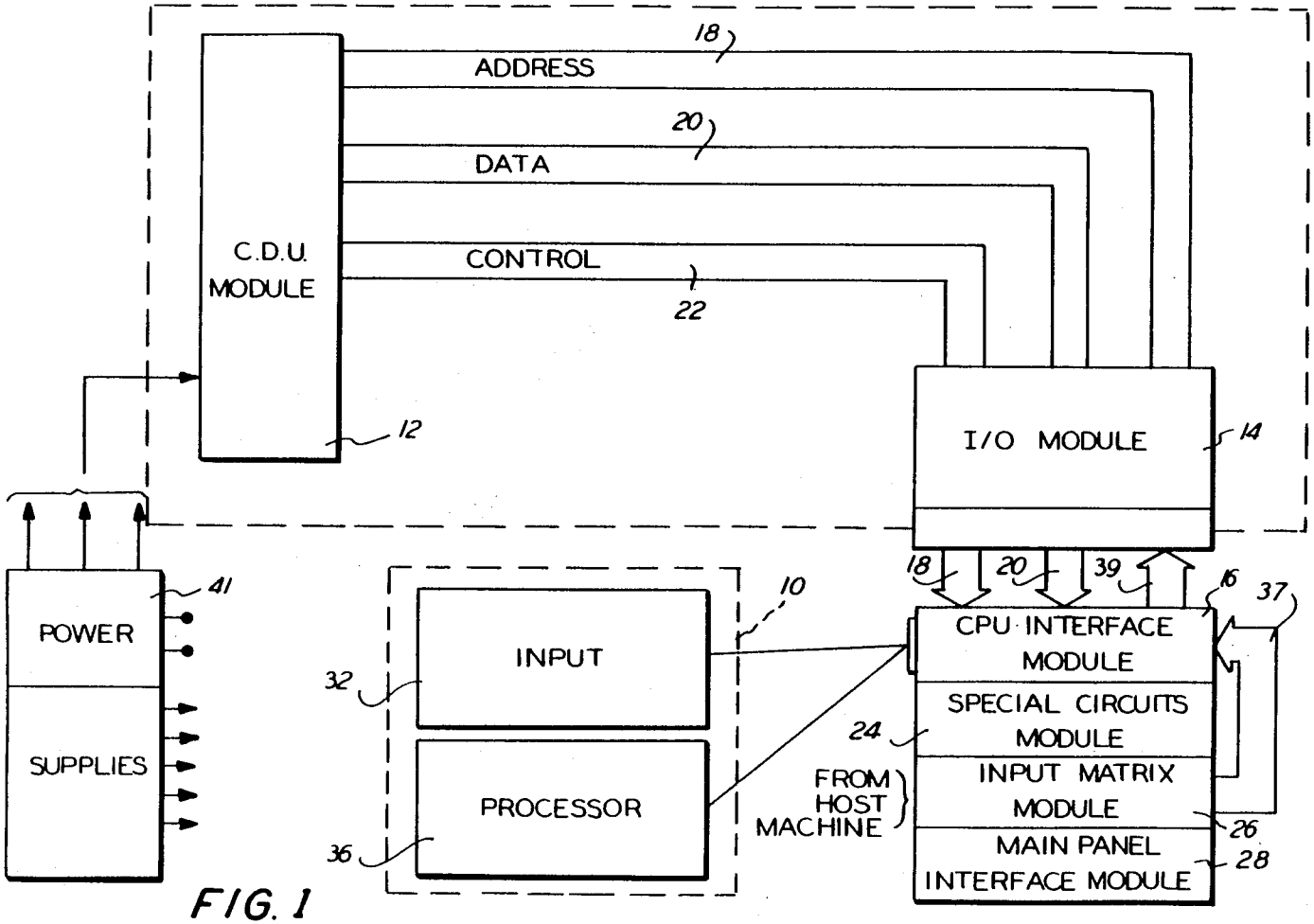
FIG. 1 is a block diagram of the control incorporating the present invention.

CPU interface module 16 connects the I/O module 14 with special circuits module 24, input matrix module 26 and main panel interface module 28. The CPU interface module 16 also interconnects I/O module 14 to the operating sections of the reproduction machine 10, namely, input section 32, and processor section 36.

Switch and sensor inputs are provided to the CPU module 12 from the machine from either the input matrix 26 or the main panel interface module 28 via data buses 37 and 39. A power supply 41 is also interconnected to CPU module 12 as well as to other control elements.

For a more detailed description of the control, reference is made to U.S. Pat. No. 4,062,061, incorporated herein.

Figure 2:
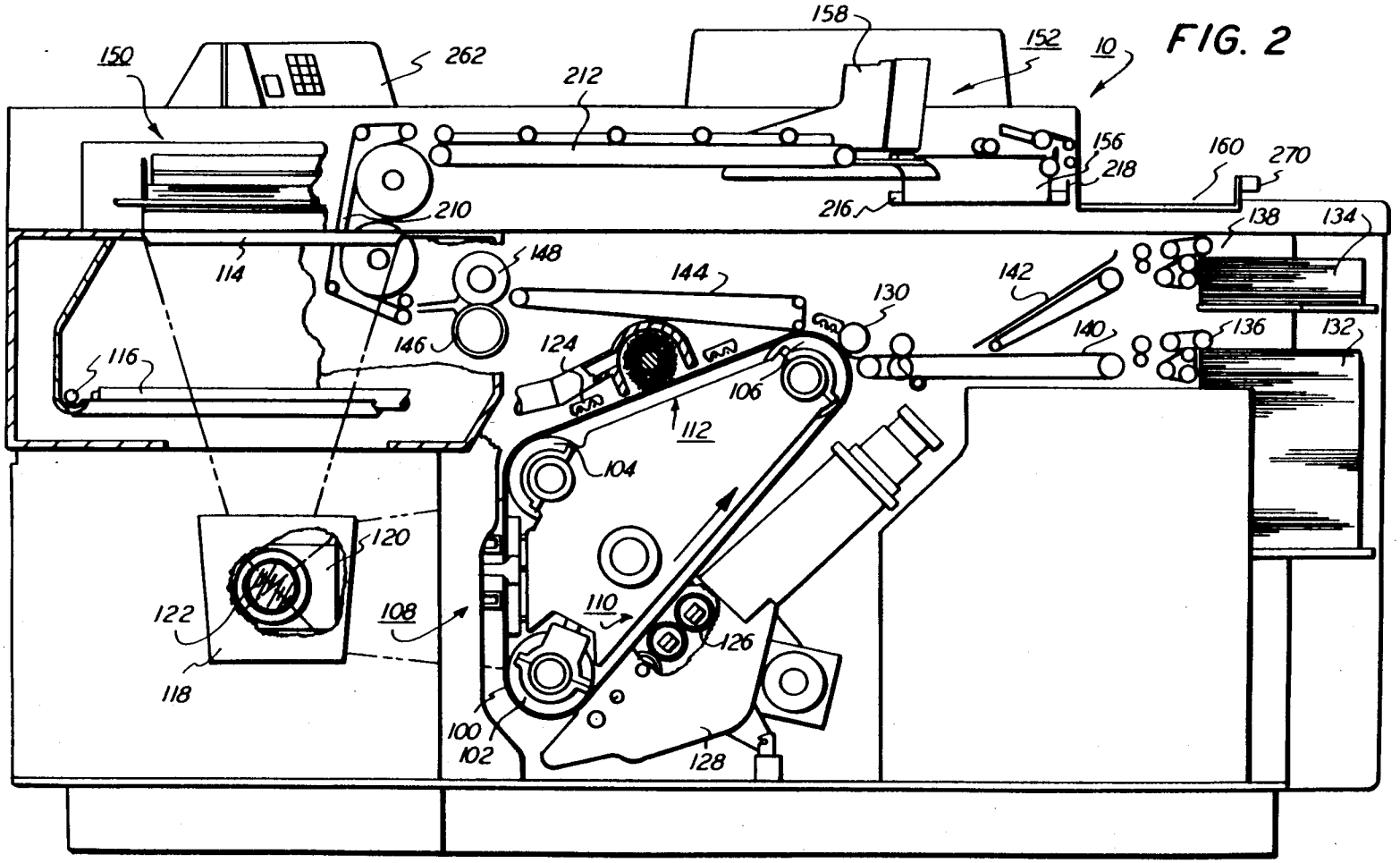
FIG. 2, is an elevational view of an exemplary reproduction apparatus incorporating the present invention.

Referring particularly to FIG. 2 of the drawings, there is shown, the an electrostatic reproduction machine or host machine 10. The machine 10 uses a photoreceptor in the form of an endless photoconductive belt 100 supported in generally triangular configuration by rolls 102, 104 and 106 and comprising a photoconductive layer of selenium, on a conductive substrate. Belt 100 is supported to provide substantially flat areas at exposure, developing, and cleaning stations 108, 110, 112 respectfully. The photoconductive belt 100 moves in the direction indicated by the solid line arrow, drive being provided through roll 106, in turn, driven by a not shown main drive motor.

Machine 10 includes a generally rectangular, horizontal transparent platen 114 on which each pair of original or documents to be copied is disposed. In accordance with the present invention, it is only necessary that the platen accommodate a pair of documents of suitable size for the signature, and as A3 or 17"×11" documents. A manual input station is provided to place an original under platen 114. A two or four sided, illumination assembly 116, disposed below and along at least two sides of platen, is provided for illuminating the original on platen 114. The light image generated by the illumination system is projected via mirrors 118, 120 and a variable magnification lens assembly 122 onto the photoreceptor belt 100 at the exposure station 108. To prepare belt 100 for imaging, belt 100 is uniformly charged to a preselected level by charge corotron 124. Magnetic brush rolls 126 are provided in a developer housing 128 at developing station 110. The bottom of housing 128 forms a sump within which a supply of developing material is contained.

To transfer developed images from belt 100 to the copy sheets, a transfer roll 130 engages copy sheets driven from either main or auxiliary tray 132, 134 by main and auxiliary sheet feeders 120, 121, respectively. Paper is generally fed from the main tray 132. Main transport 140 extends from main paper tray 132 to transfer roll 130 and is driven from the main motor. Auxiliary transport 142 extends from auxiliary tray 134 to main transport 140 and is also driven from the main motor. The image bearing sheets leaving the nip formed by photoconductive belt 100 and transfer 130 are picked off by vacuum transport 144 and conveyed to the fuser having a lower heated fuser roll 146 and upper pressure roll 148.

Figure 3:
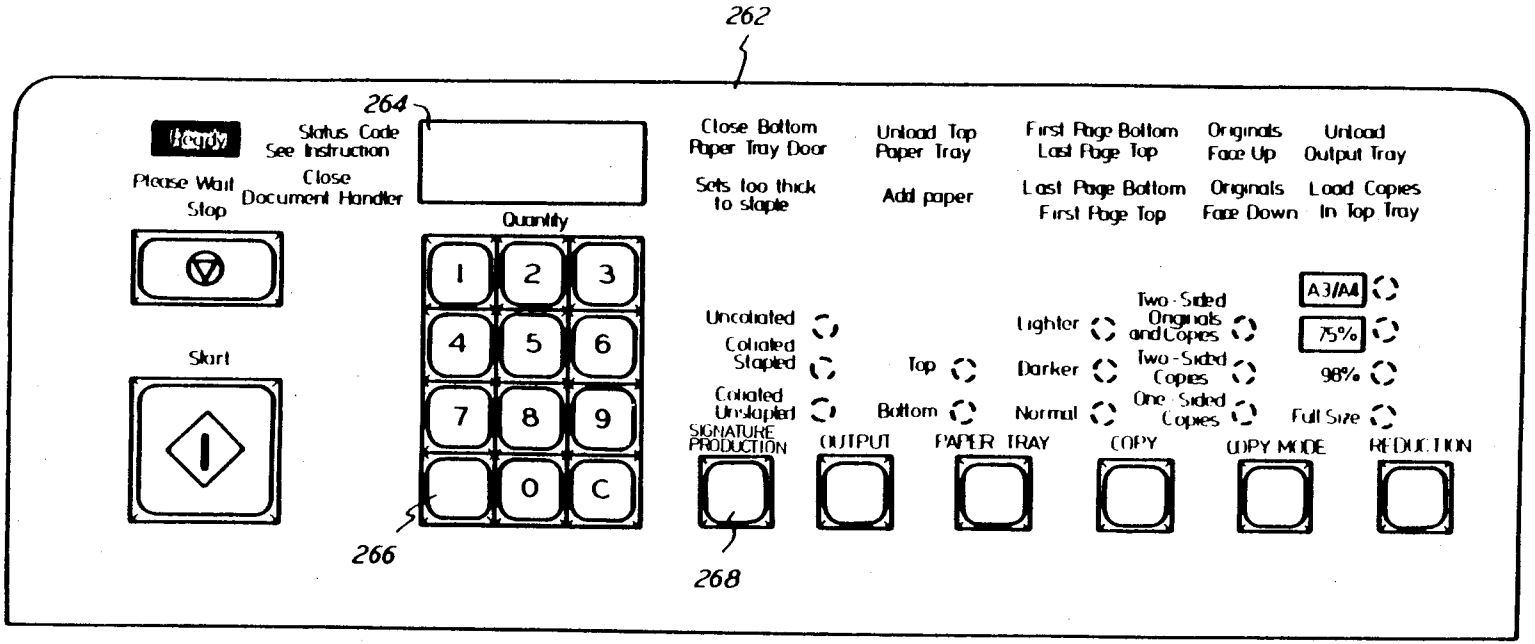
FIG. 3 is an illustration of the operator control console including display of the reproduction apparatus of FIG. 2.

With reference to FIG. 3, there is shown the operator's control console 262 including various inputs switches and indicator lamps. The interconnection of these switches and the main panel interface module 28, the input matrix module 26 and the CPU module 12 are illustrated in U.S. Pat. No. 4,062,061 incorporated herein. Of course, all connections to the CPU module are through the input/output module 14.

The console switches are continuously monitored by a switch scan procedure to initiate the correct operation for a particular combination of switch inputs. The inputs from the twenty console switches are arranged into three bytes of information. In particular, the scan is made every 20 milliseconds and in an effort to filter out noise, two readings of the byte are taken approximately 13 microseconds apart. If they are the same, a third reading is not required. If they are not the same, the result of a third reading taken approximately 13 microseconds later is used.

The machine is generally operating in one of eight different states namely an initialization, lamp test, run not print, print, ready, not ready, Tech Rep, and component control states. The system can be executing in only one state at a time. The system operates in a state until it recognizes a condition requiring a state change.

The initialization state is completed after a system self-test or system self-diagnostics and in this state, various flags and data are set to initial values required for system operation. The system then enters the lamp test state and in this state turns on all front panel lights and indicates 8888 on the digital display 264 for an automatic lamp test feature. There is a short, approximately 5 seconds, display of all the front console lamps. This occurs shortly after power is turned on. This provides an indication to the operator of any burned out or otherwise inoperative display components. This also eliminates the need for a button to request the display. It should also be understood that as machine performance is monitored over a history of use, various changes are often required to the systems software to optimize operation. Generally, these changes are made in various stages. Therefore, for diagnostic and evaluation purposes it is often desirable to know the particular stage or level of software in the system. This information is available in the digit display 264 during this period of lamp tests by keying the unmarked push button 266 on the operator's console. A coded display will indicate the level of software in the system.

After a lamp test state, the system, at the expiration of the 5 seconds, enters the not ready state. Thee are approximately 11 conditions that must be satisfied before the system changes from the not ready to the ready state. For example, the lens selection must equal the lens position switch, that is, the lens must not be in motion, the bottom and top trays if selected must have enough paper, the fuser must be up to temperature, all stand by interlocks must be closed, the fuser must not be overtemperature, the photoreceptor belt must not be mistracked, all fault codes must be cleared.

The system next enters the ready state upon satisfying the not ready conditions and is ready to enter the print state. From the ready state the system will normally go either to the print state back to the not ready state or to the Tech Rep state if required. Upon activation of the print button the system enters the print state. Upon completion of the reproduction run, or upon encountering a machine malfunction, the system exits fro the print state to a run/not print state. After the completion of this state there is entered not ready state.

In accordance with the present invention, the control console 262 includes selectively illuminated lighted displays and messages and a signature production switch 268 to enable the operator in producing signatures. As is known from the prior art, to make signatures assembled into booklets, each signature generally comprises four pages of images of four distinct documents. Two documents are laid side by side on the platen and exposed giving side by side images on one side of the copy sheet. The copy sheet is temporarily stored in a suitable receptacle and two other documents are placed side by side on the platen. These next two documents are exposed and the side by side images placed on the opposite side of the first copy sheet forming a signature and part of a booklet when folded in half. This signature then contains four pages or images and when folded together and nested with other signatures will form a complete booklet.

Figure 4:
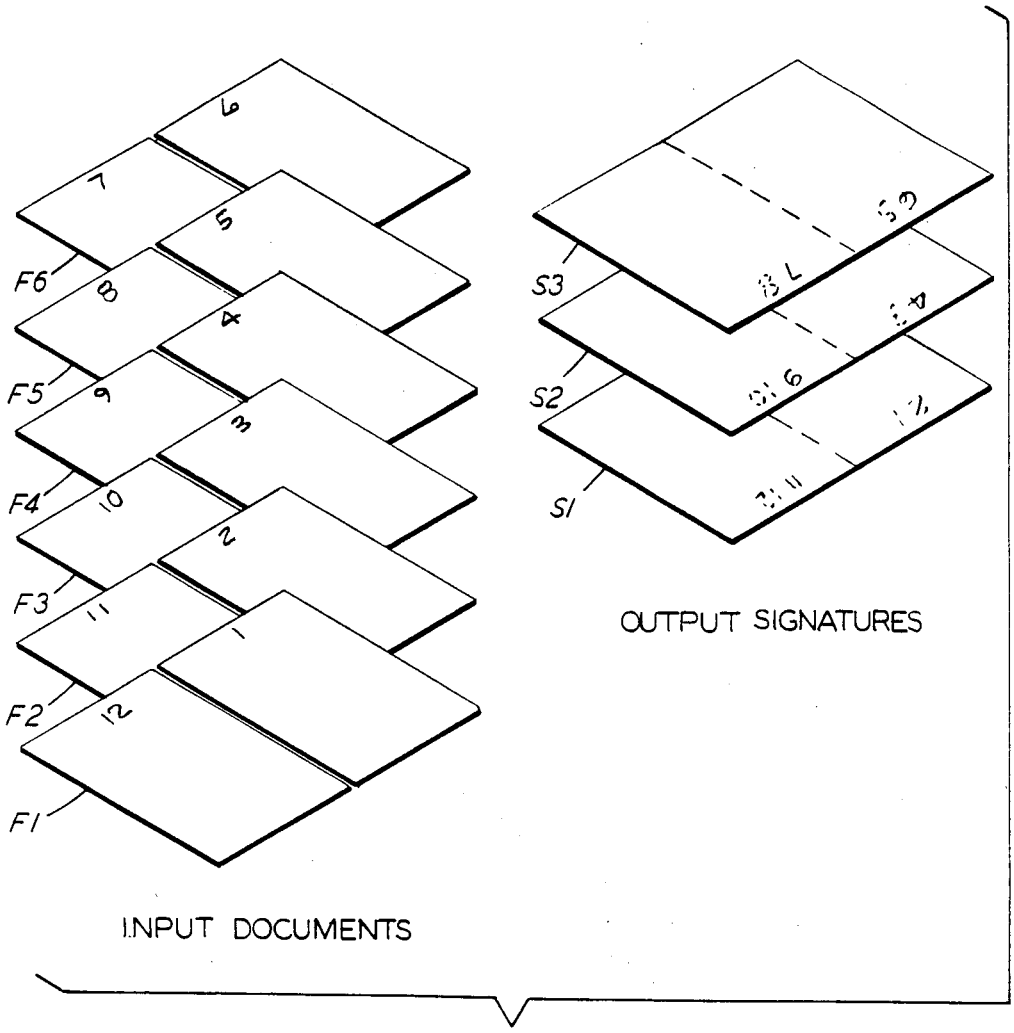
FIG. 4 illustrates document input relative to copy sheet or signature output for the production of a booklet.

FIG. 4 illustrates document pair F1 (pages 12 and 1) being the first input document pair to be imaged on the underside of copy sheet or signature S1 shown by the dotted numbers 1 and 12 The next document pair F2 (pages 11 and 12) is imaged on the top side of copy sheet S1 forming the first signature. Similarly, document pairs F3 and F4 are imaged on copy sheet or signature S2 with the images of document pair F3 being on the underside. Document pairs F5 and F6 are imaged on signature S3. The final booklet of 12 pages comprises signatures S1, S2, and S3 with the relative position of the images of pages 1-12 as shown.

The difficulty in producing the booklets is the page ordering and the sequence of placing the documents on the platen in order to have consecutive pages or images in the final booklet.

Figure 5:
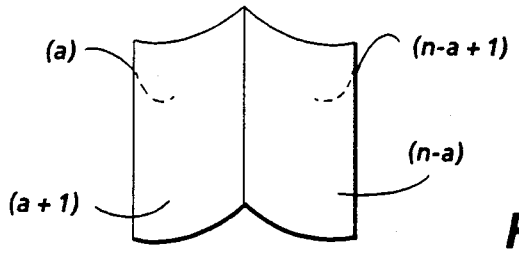
FIG. 5 is an illustration of page numbering for each signature $N_i$.

In accordance with the present invention, the pagination of some typical signature ($N_i$) is shown in FIG. 5. Assuming N=Total Number of Signatures in Set, then n=4N where n=total number of pages (including required blanks) in the booklet.

Also $N=n_{D/4}$ (rounded up to an integer if necessary), where $n_D$ is the total number of single page documents determining the total number of signatures N required.

With these definitions, the first page number a of any given signature $N_i$ is given by the following equation:

$a=2N_i-1$, where a is illustrated in FIG. 5 as one side of the underside of the signature $N_i$, where $N_{1=1}$, $N_2=2$, etc.

The other underside is $(n-a+1)$ and the two face up pages are $(a+1)$ and $(n-a)$.

It can be seen that the total number of pages (n) or faces is set by the number of signatures such that:

$n=n_D$ plus (0, 1, 2, 3) such that n is multiple of four

A useful property of signature pagination is, that for all of the signatures, there exists a unique page number total of the four pages contained on any of the signature in that set, i.e.

$V=2(n+1)$ where V=the total value of page numbers for any signature

This can be used to check the pagination on each signature. By comparing the check value V to the page total for each signature, the operator can easily verify that the pagination is correctly done.

Figure 6:
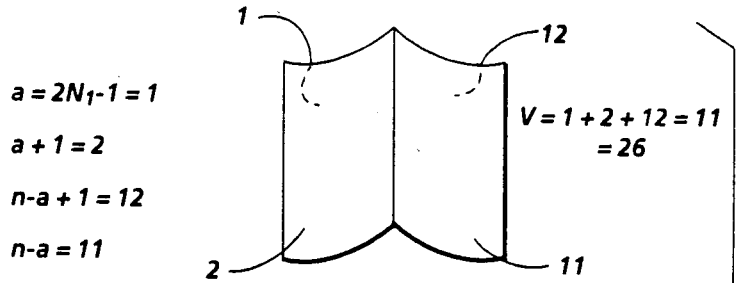
FIG. 6 is an example of page numbering in accordance with the present invention for a three signature booklet, also illustrating the check value.
Figure 6:
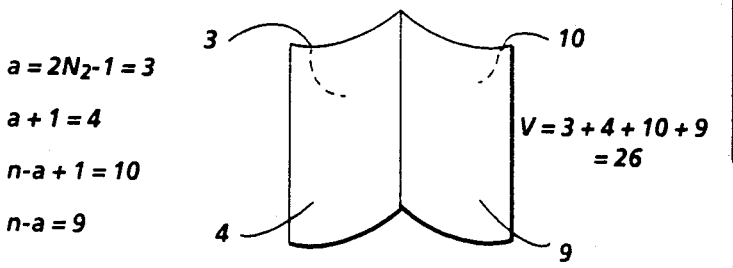
Figure 6:
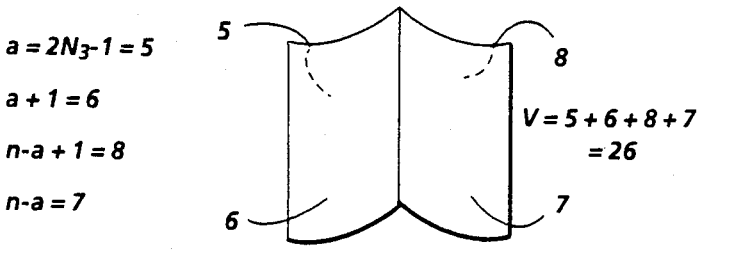

For example, with reference to FIG. 6, there is shown a sample three signature, 12 page booklet and the calculation of the correct page number and the correct check value for each signature 1, 2 and 3. As illustrated in FIG. 6, there must be four correct page numbers for each signature, two of the page numbers facing up and two of the page numbers facing down. As shown in FIG. 5, the two page numbers facing down are (a) and $(n-a+1)$ where $(a=2N_i-1)$. The two face up page numbers are $(a+1)$ and $(n-a)$. By substituting the correct values of a and n in these formulas for each signature, the correct value or page number is determined. That is since N=3 (3 signatures), n=4N=12. Also, since $a=2N_i-1$, for signature 1 or ($N_1$) then $a=2(1)-1=1$. By use of these expressions, as shown in FIG. 6, it can be seen that for signature $N_1$, face down page numbers are 1 on the left and 12 on the right and the face up page numbers are 2 on the left and 11 on the right. For signature $N_2$, the correct face down page numbers are page 3 on the left and page 10 on the right and for the face up pages, number 4 on the left and number 9 on the right. Similarly, for signature $N_3$, the page numbers down are 5 and 8 and the page numbers up are 6 and 7. It can be seen, therefore, properly assembled the three signatures will give consecutive pages 1 through 12. For each signature, substituting a total number of pages n=12 in the formula for the check value b, i.e., $$V=2(n+1)=26$$

It can be seen that each adding up for each signature the value of each page number equals 26.

Figure 7:
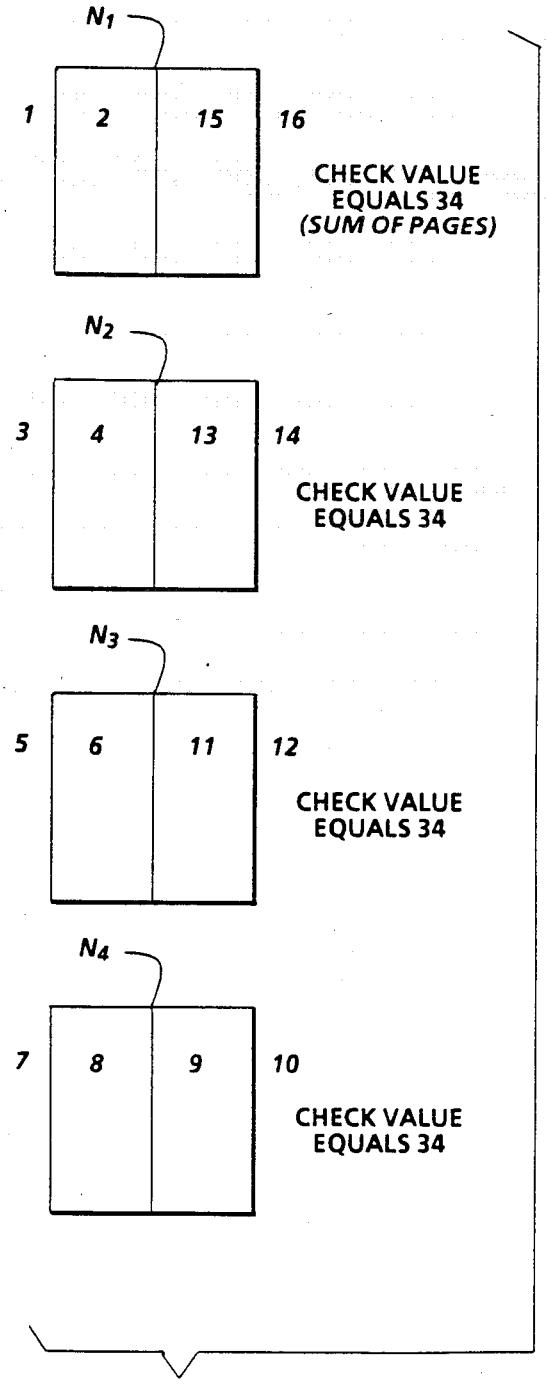
FIG. 7 illustrates the console (user interface) displayed operator interaction in accordance with the present invention.

With reference to FIG. 7 there is illustrated, in a preferred embodiment the sequence of displays for the operator. Upon activation of the signature production switch 268 on the console 262 illustrated in FIG. 3, there would be entered on the display 264 the prompt "Enter Number of Pages to appear in the Book". If for example, an odd number of pages such as 13 were to be combined into a booklet, the operator would enter the number "13". With routine programming, the control would then calculate and display the total number of pages in the finished book (including blank), i.e. 16 and the total number of signatures—4. The display preferably would also inform the operator three blank pages were required to complete the book. The check value would than be determined in this case to be 34. This value would also be displayed.

Finally, the pagination of signatures would be displayed as illustrated. For example for the first signature there is illustrated pages 2 and 15 for the pages facing up in the signature and numbers 1 and 16 for the pages facing down. Also the check value 34 is calculated for signature 1. Likewise, signature 2 facing up numbers illustrated are 4 and 13 and the facing down page numbers are 3 and 14 and again the check value is determined to be correct at 34. Similarly, the correct page numbers for signatures 3 and 4 are displayed. The check value can be done automatically or manually by the operator. Once the signatures are assembled into the final booklet form, it can be seen that pages 1 through 13 are consecutive and that pages 14, 15 and 16 would, in fact, be blank. Included as Appendix I on a separate sheet is an APL Program that implemented the signature production procedure and machine operator display interaction in accordance with the present invention.

While there has been illustrated and described what is at present considered to be a preferred embodiment of the present invention, it will be appreciated that numerous changes and modifications are likely to occur to those skilled in the art, and it is intended in the appended claims to cover all those changes and modifications which fall within the true spirit and scope of the present invention.

APPENDIX I

APL PROGRAM USED TO PRODUCE THE PRECEDING SIMULATE OPERATOR/MACHINE INTERACTIONS.

```
∇PAGES[□]∇
∇ PAGES;AA;A;NO;NT;K;N;A1;A2;A3;A4;B
```

APPENDIX I-continued

APL PROGRAM USED TO PRODUCE THE PRECEDING SIMULATE OPERATOR/MACHINE INTERACTIONS.

```
[1]   HENRY BOBERS SIGNATURE PROGRAM
[2]   ⍝WRITTEN BY N.DOERY 28 NOV 83
[3]   ⍝'ENTER NUMBERS OF IMAGES TO APPEAR IN THE BOOK' ⋄NO←⎕
[4]   →(NO>0)/L1    'NUMBER OF IMAGES MUST BE GREATER THAN ZERO' ⋄ →2
[5]   →(1|NO=0)/L1 ⋄'NUMBER OF IMAGES MUST BE AN INTEGER VALUE'    →2
[6]  L1:'TOTAL NUMBER OF PAGES IN FINISHED BOOK IS: ';+NT←4×N←  NO+4
[7]   'TOTAL NUMBER OF SIGNATURES IS: ';N
[8]   →((NT−NO)=0)/1+  26⋄ NT−NO;' BLANK PAGES WERE REQUIRED TO COMPLETE THIS BOOK'
[9]   'THE CHECK VALUE IS: ';2×NT+1
[10]  K←1
[11]  A1←'    |---T---|' ⋄A2←'    |    |    |    '
[12]  A3← 2 15 ρ'    T|    |    |'    A4←'    |____ ____|'
[13] L2:A← 1+2×K⍳  AA←,'I3' ⎕FNT(B←,(A,(NT−A))⍉.+ 0 1)
[14]  A2[1 2 3 6 7 8 12 13 14 17 18 19]←AA
[15]  ''
[16]  ''
[17]  A1
[18]  A2,'   CHECK VALUE IS: ';+/B
[19]  A3
[20]  A4
[21]  →(N≥K←K+1)/L2
  ∇
```

We claim:

1. In a copier having a control (user interface) and a plurality of operating components cooperating with one another to produce impressions on copy sheets, the operating components including a photoreceptor, a platen for supporting first side by side documents to be imaged, an optical system for projecting images of the documents onto the photoreceptor, a developer for developing images of the side-by-side documents on one side of a copy sheet, the side one copy sheet later receiving images of second side-by-side documents on the platen, the control including a console for displaying operator messages and for entering program data, the method for providing completed signature sets for center folding such sets for assembly into booklet form comprising the steps of:

(a) entering into the console the number of pages to appear in the completed signature sets, (b) determining a check value for document orientation to provide signatures, (c) displaying the orientation of documents in signatures for the correct placement of documents on the platen, (d) loading a first pair of documents onto the platen in the orientation as shown on the display for side one of the first signature copy sheet, (e) producing images of the first pair of documents on side one of the first signature copy sheet, (f) loading a second pair of documents onto the platen in the orientation as shown on the display for side two of the first signature copy sheet, (g) producing images of the second pair of documents on side two of the first signature copy sheet, and (h) repeating steps d, e, f and g until all signatures are produced in the proper orientation for assembly into a booklet form.

2. The method of claim 1 including the step of verifying each completed signature copy sheet with said check value by adding page numbers.

3. The method of claim 1 including the steps of displaying the total number of pages to be in the finished booklet and the step of displaying the total number of signatures to be provided.

4. In a copier having a control and a plurality of operating components cooperating with one another to produce impressions on copy sheet, the operating components including a photoreceptor, a platen for supporting documents to be imaged, an optical system for projecting images of the documents onto the photoreceptor, a developer for developing images of the documents on a copy sheet, the control including a console for displaying operator messages and for entering program data, the method for providing completed signature sets for center folding said sets for assembly to booklet form comprising the steps of:

(a) displaying the orientation of documents in signatures for the correct placement of documents on the platen, (b) loading a first pair of documents onto the platen in the orientation as shown on the display for side one of the first signature copy sheet, (c) producing images of the first pair of documents on side one of the first signature copy sheet, (d) loading a second pair of documents onto the platen in the orientation as shown on the display for side two of the first signature copy sheet, (e) producing images of the second pair of documents on side two of the first signature copy sheet, and (f) repeating steps b, c, d, and e until all signatures are produced in the proper orientation for assembly into a booklet form.

5. The method of claim 4 including the step of entering into the console the number of pages to appear in the completed signature sets.

6. The method of claim 4 including the step of calculating a check value that is the total of the four page numbers on a correct completed signature copy sheet.

7. The method of claim 4 including the step of assembling a booklet from the completed signature copy sheets.

* * * * *